United States Patent [19]

Trotta

[11] 4,413,411

[45] Nov. 8, 1983

[54] RAZOR HANDLE

[75] Inventor: Robert A. Trotta, Pembroke, Mass.

[73] Assignee: The Gillette Company, Boston, Mass.

[21] Appl. No.: 359,877

[22] Filed: Mar. 19, 1982

Related U.S. Application Data

[63] Continuation-in-part of Ser. No. 352,146, Feb. 25, 1982.

[51] Int. Cl.[3] ..... B26B 21/14

[52] U.S. Cl. ..... 30/85; 30/64

[58] Field of Search ..... 30/47, 64, 85, 335

[56] References Cited

U.S. PATENT DOCUMENTS

| | | | |
|---|---|---|---|
| 1,276,712 | 8/1918 | Van den Berg | 30/89 X |
| 3,646,674 | 3/1972 | Fitzpatrick | 30/64 |
| 3,815,227 | 6/1974 | Hood | 30/64 |
| 3,918,155 | 11/1975 | Atkins | 30/47 |
| 4,198,746 | 4/1980 | Trotta | 30/89 |
| 4,227,302 | 10/1980 | Torrance | 30/47 |
| 4,281,455 | 8/1981 | Dixon et al. | 30/89 |

*Primary Examiner*—Jimmy C. Peters

*Attorney, Agent, or Firm*—Scott R. Foster

[57] ABSTRACT

A razor handle comprising an elongated grip portion, a neck portion extending from one end of the grip portion and disposed at an angle to the grip portion, a protrusion extending from an end of the neck portion remote from the grip portion, a connecting web joining the protrusion to the neck portion and being of reduced thickness to provide a recess between the neck portion and the protrusion and a plunger disposed in the neck portion, a first end of the plunger being accessible from the grip portion and a second end of the plunger being proximate the remote end of the neck portion, the plunger being movable in the bore.

2 Claims, 7 Drawing Figures

RAZOR HANDLE

CROSS-REFERENCE TO RELATED APPLICATION

This is a continuation-in-part of application Ser. No. 352,146, filed Feb. 25, 1982, in the name of Robert Anthony Trotta.

BACKGROUND OF THE INVENTION

1. Field of the Invention

The invention relates to wet shaving systems, and is directed more particularly to a razor handle suitable for use in such a system.

2. Description of the Prior Art

Shaving cartridges having blade elements permanently secured therein are well known in the art. Examples of such cartridges may be found in U.S. Pat. Nos. 1,864,995—T. H. Frost; 2,654,148—W. M. Robinson; 2,676,397—J. De Bacco et al; 3,388,831—B. S. Hansom; 3,660,893—N. C. Welsh; 3,703,764—R. L. Perry; 3,783,510—J. Dawidowicz; and 4,026,016—W. I. Nissen.

Several structures for interconnecting such cartridges and complimentary handles have been disclosed. For example, in Robinson, Perry and Dawidowicz, a slide arrangement is utilized, in Frost a screw connection is shown, in De Bacco and Hansom a cartridge is held between jaws; in Nissen a pivotal connection is disclosed.

In U.S. Pat. application Ser. No. 352,150, there is disclosed a shaving cartridge having a unique and improved means for interconnecting with a razor handle. In U. S. Pat. application Ser. No. 352,146, there is disclosed a razor handle suitable for use with shaving units of the type disclosed in U.S. Pat. application Ser. No. 352,150.

SUMMARY OF THE INVENTION

An object of the present invention is to provide a razor handle suitable for use with shaving units, or cartridges, of the type disclosed in the above referred to U.S. Pat. application Ser. No. 352,150, the razor handle comprising an improvement over the razor handle disclosed in the above referred to U.S. Pat. application Ser. No. 352,146.

With the above and other objects in view, as will hereinafter appear, a feature of the present invention is the provision of a razor handle comprising an elongated grip portion, a neck portion extending from one end of the grip portion at an angle thereto, a protrusion extending from a free end of said neck portion, a web means interconnecting said protrusion and said free end of said neck portion, said web being of lesser thickness than said protrusion to provide recess means betweeen said protrusion and said free end of said neck portion, and plunger means disposed in said neck portion, a first end of said plunger means being accessible from said grip portion and a second end of said plunger means being proximate said remote end of said neck portion, said plunger means being movable.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
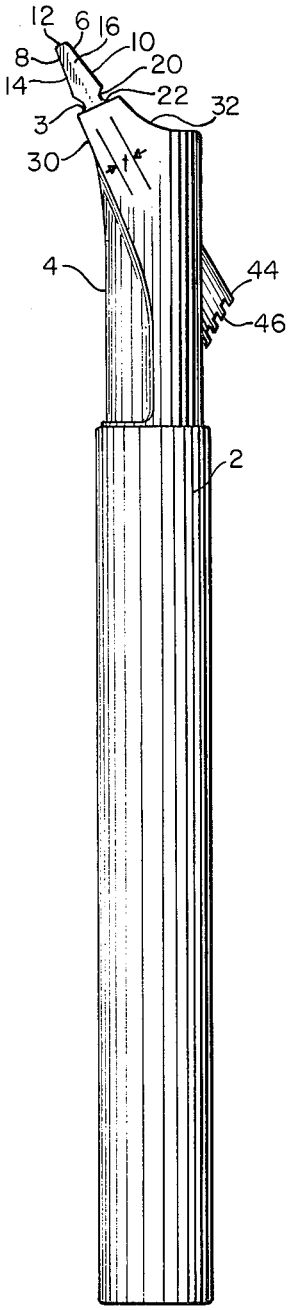
FIG. 1 is a side elevational view of one form of razor handle illustrative of an embodiment of the invention.
Figure 2:
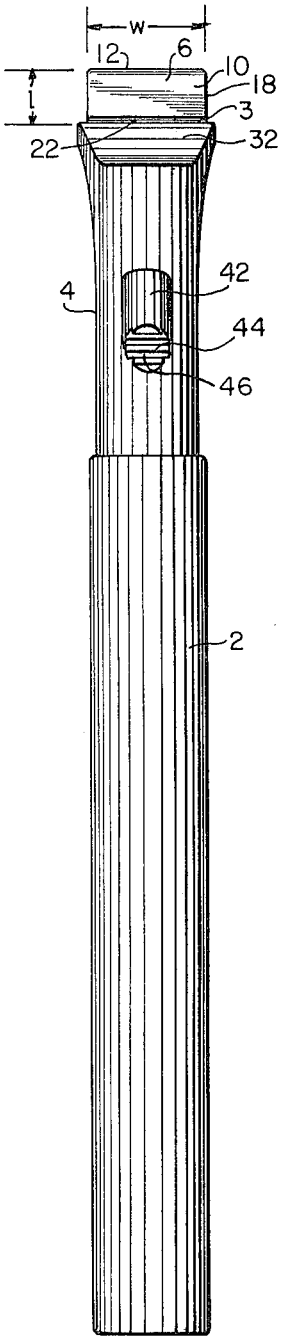
FIG. 2 is a rear elevational view thereof.
Figure 3:
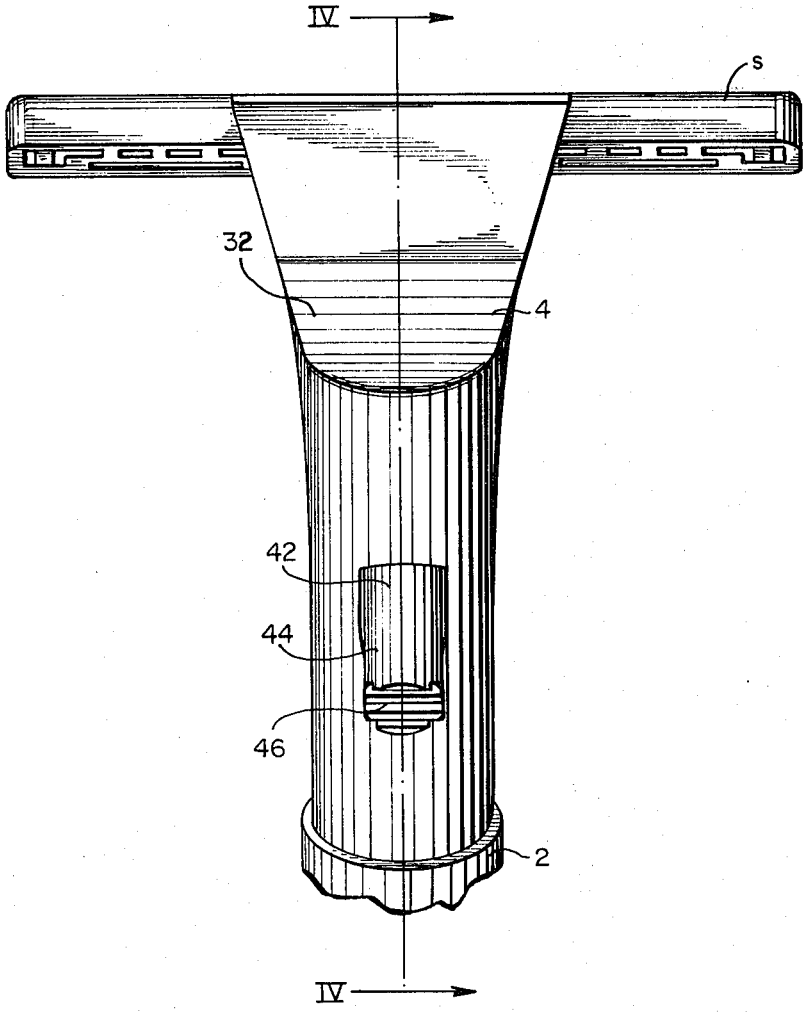
FIG. 3 is similar to FIG. 2, but showing the razor handle in combination with a shaving cartridge.
Figure 4:
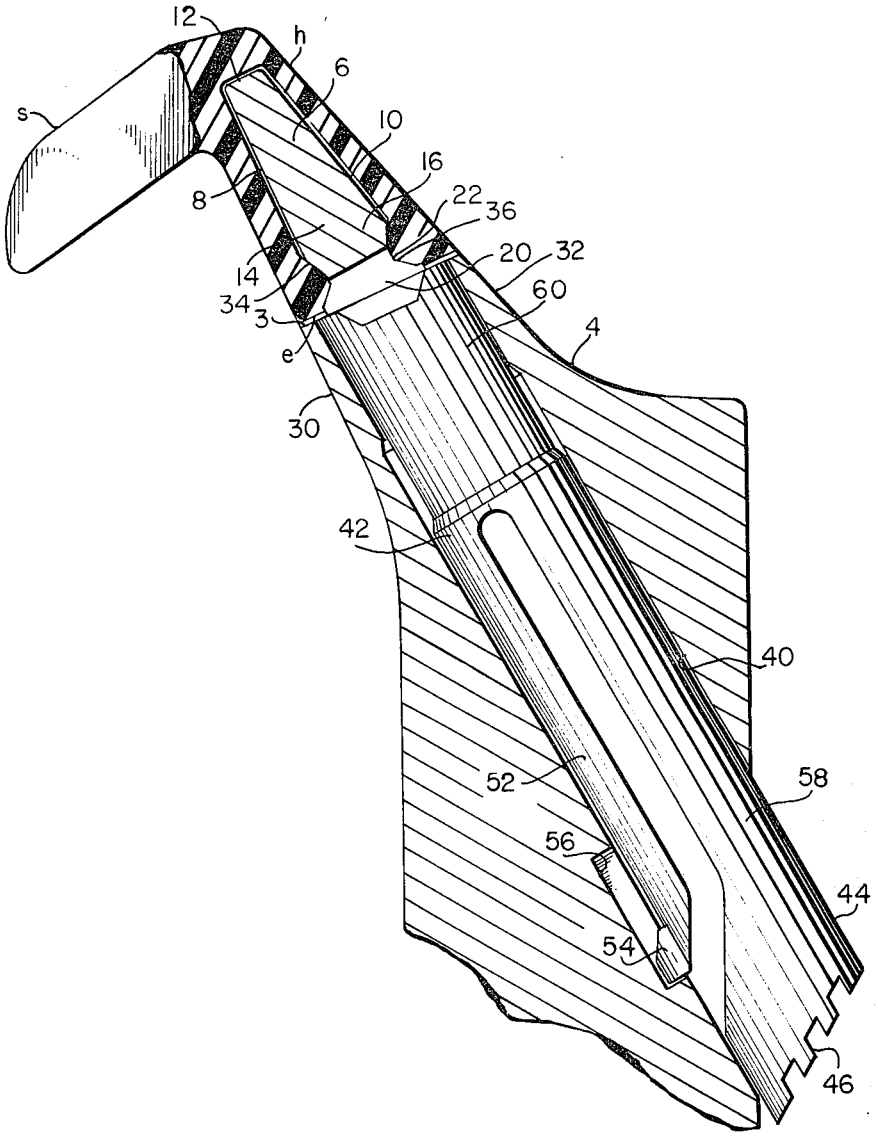
FIG. 4 is a sectional view taken along line IV–IV of FIG. 3.
Figure 5:
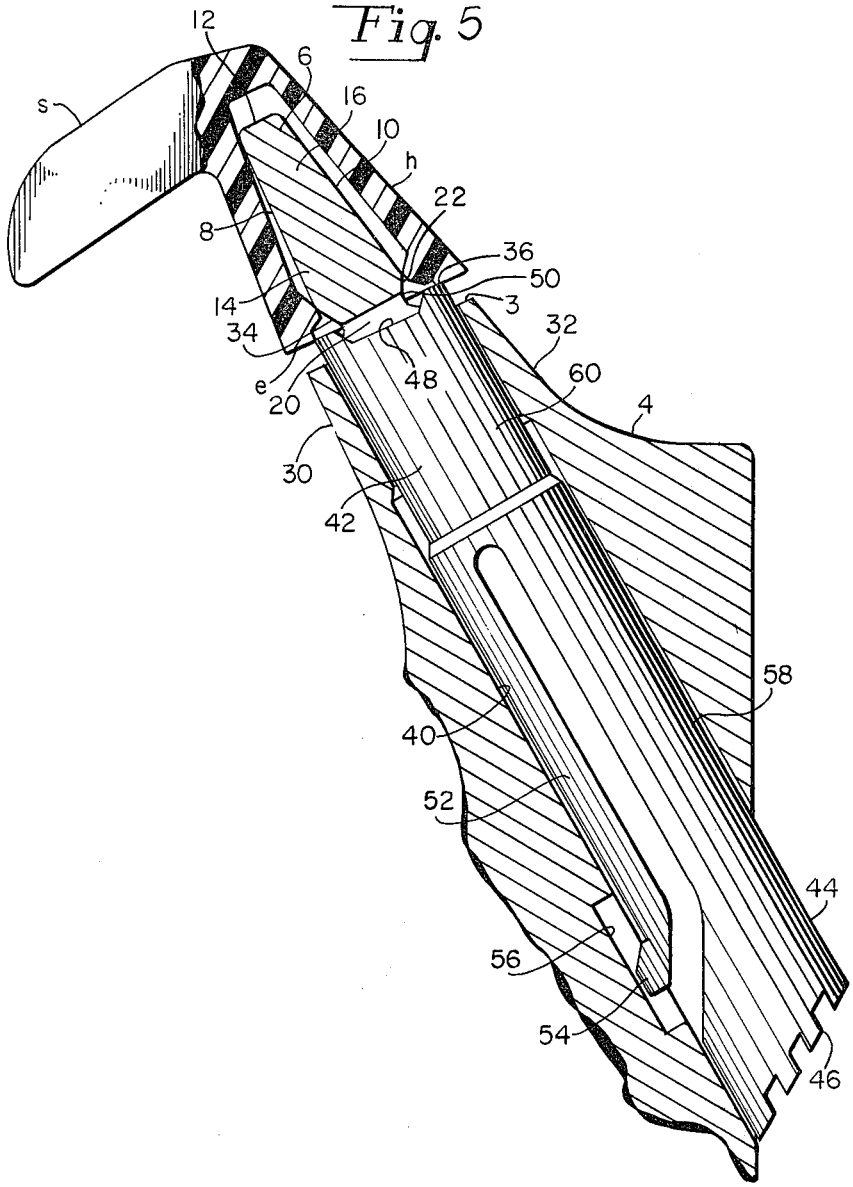
FIGS. 5–7 are similar to FIG. 4, but showing a portion of the illustrative handle in various operating positions and in combination with a shaving cartridge.
Figure 6:
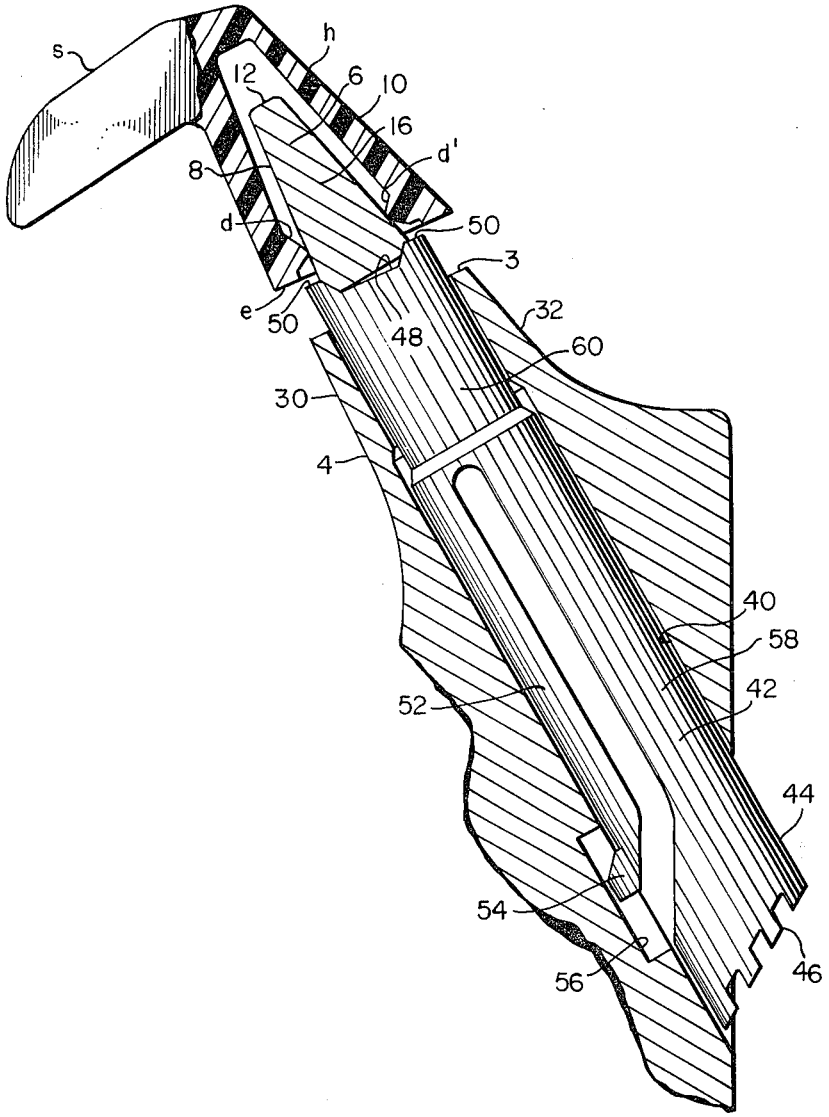
Figure 7:
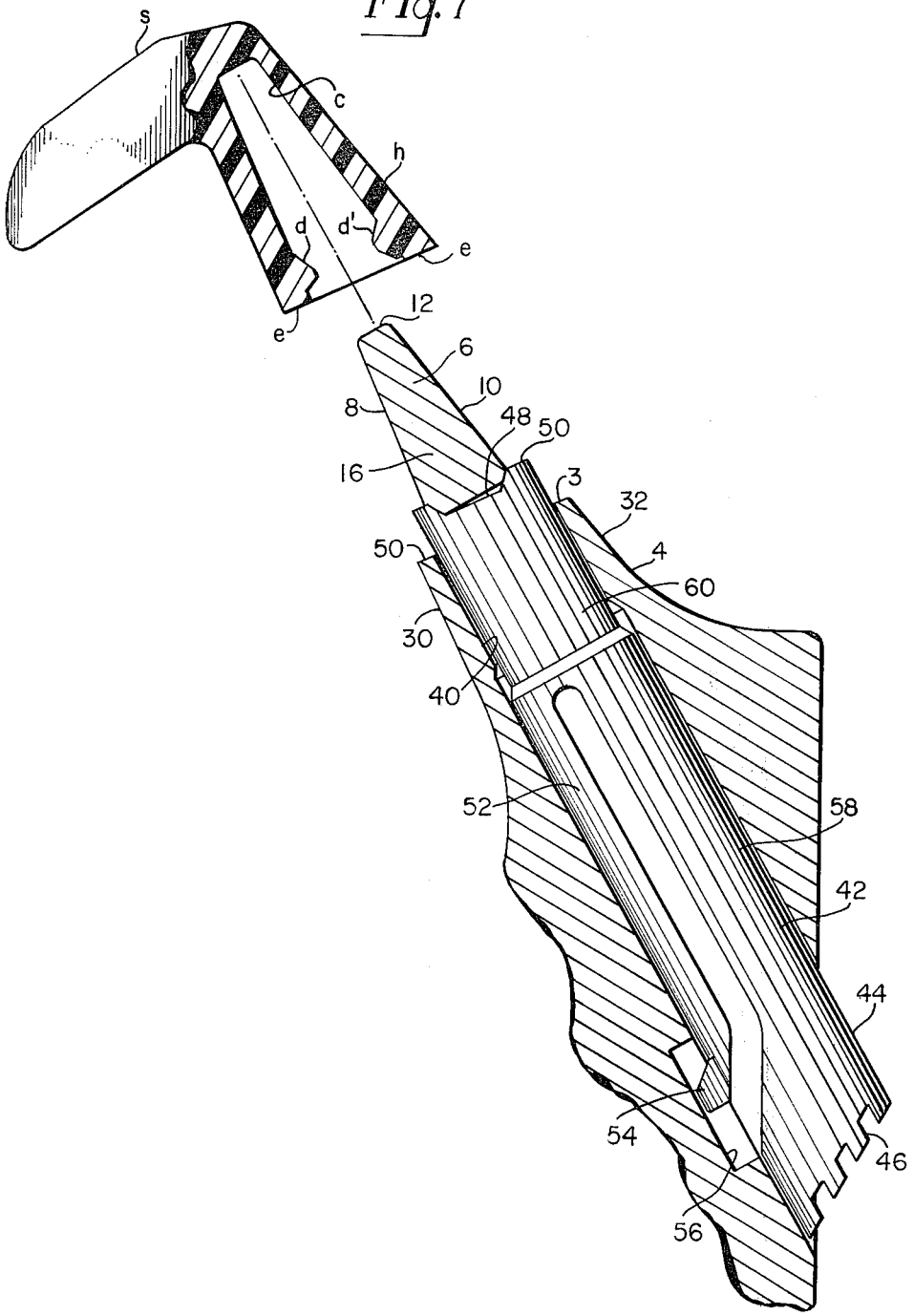

Referring to the drawings, it will be seen that the illustrative razor handle includes an elongated grip portion 2 and a neck portion 4 extending from one end of the grip portion and disposed at an angle to the grip portion.

Extending from an end 3 of the neck portion 4 remote from the grip portion 2 is a protrusion 6. The protrusion 6 has first and second major planar surfaces 8, 10 extending from a free end 12 of the protrusion, at which the surfaces 8, 10 are closest to each other, to a base portion 14, at which the surfaces 8, 10 are farthest apart. Substantially wedge-shaped end walls 16, 18 interconnect the surfaces 8, 10 along the side edges of the surfaces.

A connecting web 20 joins the base portion 14 of the protrusion 6 to the end 3 of the neck portion 4, the connecting web being of lesser thickness than the protrusion base portion, to provide recess means 22 between the end 3 of the neck portion 4 and the protrusion base portion 14.

The protrusion 6 is in substantial alignment with the neck portion 4, extending outwardly at an angle to the grip portion 2.

Referring to FIG. 1, it will be seen that the neck portion 4 is defined in part by front and rear walls 30, 32, preferably forming continuations, respectively, of front and rear walls of the grip portion. The first major planar surface 8 and the second major planar surface 10 are at an angle to each other, such that at the free end 12 of the protrusion, the surfaces are closest together (preferably about 0.043 in.) and at the base portion 14 of the protrusion the surfaces are farthest apart (preferably about 0.093 in.). The protrusion is preferably about 0.25 in. in length l and 0.42 in. in width w. The recess means 22 preferably comprises two recesses 34, 36 defined in part by the web, which is about 0.066 in. in thickness t.

In the neck portion 4 there is provided a bore 40 (FIGS. 4–7) in which is disposed a plunger 42 having a first end 44 accessible from the grip portion 2 and defining a push button 46 for manual operation. The plunger 42 is provided with a second end 48 proximate the free end 3 of the neck portion 4. The second end 48 of the plunger 42 is provided with end surfaces 50. The plunger 42 may comprise a unitary molding including an attachment leg 52 having a detent 54 thereon slidably disposed in a recess 56 in the bore 40, and a trunk portion 58 movable in the bore 40, the leg and trunk portions 52, 58 being joined at a common base portion 60.

To remove a shaving unit s from the handle, an operator presses the push button 46, causing the end surfaces 50 to push against an edge e of a housing portion h of the shaving unit s, forcing detents d, d' to override the base portion 14 of the protrusion 6. Plastic deformation of the shaving unit housing portion permits removal of the shaving unit and reuse of the handle with subsequent shaving units. Preferably, the grip portion, neck portion, web and protrusion are molded or cast integrally as a unit, of plastic or of a more rigid material, such as metal.

In attaching another saving unit to the handle, the protrusion 6 is introduced into a cavity c, defined by the housing portion h of the shaving unit s, the housing portion h having the inwardly directed opposed detents d, d'. The widest portion of the base portion 14, overrides the detents d, d', which snap into the recesses 34, 36 to lock the shaving unit s on the handle. Attachment of a new shaving unit forces the plunger 42 back to the position shown in FIG. 4.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A razor handle comprising an elongated grip portion, a neck portion extending from one end of said grip portion and disposed at an angle to said grip portion, and a protrusion extending from an end of said neck portion remote from said grip portion, a connecting web joining said protrusion to said end of said neck portion, said connecting web being of lesser thickness than said protrusion, whereby to provide recess means between said end of said neck portion and said protrusion, said protrusion being in substantial alignment with said neck portion, and plunger means disposed in said neck portion, a first end of said plunger means being accessible from said grip portion and a second end of said plunger means being proximate said remote end of said neck portion, said plunger means being movable.

2. The invention in accordance with claim 1 in which said neck portion is provided with a bore and said plunger means is disposed in said bore.

* * * * *